US008833095B2

(12) United States Patent
Beers et al.

(10) Patent No.: US 8,833,095 B2
(45) Date of Patent: Sep. 16, 2014

(54) APPARATUS AND METHOD FOR DRY CYCLE COMPLETION CONTROL IN HEAT PUMP DRYER BY DECLINING CAPACITY INDICATION BY ROLLING AVERAGE COMPRESSOR WATTS OR HEAT EXCHANGER PRESSURE OR TEMPERATURE

(75) Inventors: David G. Beers, Elizabeth, IN (US); Amelia Lear Hensley, Louisville, KY (US); Nicholas Okruch, Jr., Mount Washington, KY (US)

(73) Assignee: General Electric Company, Schenectady, NY (US)

( * ) Notice: Subject to any disclaimer, the term of this patent is extended or adjusted under 35 U.S.C. 154(b) by 795 days.

(21) Appl. No.: 12/875,306

(22) Filed: Sep. 3, 2010

(65) Prior Publication Data

US 2012/0017615 A1 Jan. 26, 2012

Related U.S. Application Data

(63) Continuation-in-part of application No. 12/843,148, filed on Jul. 26, 2010, now Pat. No. 8,353,114.

(51) Int. Cl.
*F25B 27/00* (2006.01)

(52) U.S. Cl.
USPC ..... 62/238.1

(58) Field of Classification Search
USPC ..... 62/115, 190, 238.1, 238.7; 34/108, 138, 34/427, 499
See application file for complete search history.

(56) References Cited

U.S. PATENT DOCUMENTS

| | | | |
|---|---|---|---|
| 2,495,535 | A | 2/1950 | Falk |
| 2,676,418 | A | 4/1954 | Shewmon |
| 3,250,097 | A | 5/1966 | Czech |
| 3,290,793 | A | 12/1966 | Jacobs et al. |
| 3,426,555 | A | 2/1969 | McCutcheon, Jr. |
| 3,861,056 | A | 1/1975 | Behrens |
| 4,433,557 | A | 2/1984 | McAlister |
| 4,441,546 | A | 4/1984 | Vandervaart |
| 4,481,786 | A | 11/1984 | Bashark |
| 4,555,019 | A | 11/1985 | Spendel |
| 4,603,489 | A | 8/1986 | Goldberg |

(Continued)

FOREIGN PATENT DOCUMENTS

| | | | |
|---|---|---|---|
| DE | 3406678 | A1 | 9/1985 |
| DE | 3543722 | A1 | 10/1987 |

(Continued)

*Primary Examiner* — Melvin Jones
(74) *Attorney, Agent, or Firm* — Douglas D. Zhang; Global Patent Operation

(57) ABSTRACT

An apparatus includes a mechanical refrigeration cycle arrangement having a working fluid and an evaporator, a condenser, a compressor, and an expansion device, cooperatively interconnected and containing the working fluid. The apparatus also includes a drum to receive clothes to be dried, a duct and fan arrangement configured to pass air over the condenser and through the drum, a sensor located to sense at least one parameter, and a controller coupled to the sensor and/or the compressor. The parameter(s) includes at least one of temperature of the working fluid, pressure of the working fluid, and power consumption of the compressor. The controller is operative to monitor, as a function of time, the parameter(s), determine whether the parameter(s) reaches a predetermined decision condition; and, if the parameter(s) reaches the predetermined decision condition, power down the mechanical refrigeration cycle at least by causing the compressor to shut off.

24 Claims, 13 Drawing Sheets

(56) References Cited

U.S. PATENT DOCUMENTS

| | | | | |
|---|---|---|---|---|
| 4,621,438 | A | 11/1986 | Lanciaux | |
| 4,640,022 | A | 2/1987 | Suzuki et al. | |
| 4,800,655 | A | 1/1989 | Mori et al. | |
| 5,301,516 | A | 4/1994 | Poindexter | |
| 5,806,204 | A | 9/1998 | Hoffman et al. | |
| 6,557,266 | B2 | 5/2003 | Griffin | |
| 6,784,997 | B2 | 8/2004 | Lorenz et al. | |
| 7,010,363 | B2 | 3/2006 | Donnelly et al. | |
| 7,020,985 | B2 | 4/2006 | Casey et al. | |
| 7,055,262 | B2 * | 6/2006 | Goldberg et al. | 34/86 |
| 7,194,823 | B2 | 3/2007 | Nakamoto et al. | |
| 7,478,547 | B2 | 1/2009 | Okazaki et al. | |
| 7,653,443 | B2 | 1/2010 | Flohr | |
| 7,665,227 | B2 | 2/2010 | Wright et al. | |
| 7,735,345 | B2 | 6/2010 | Wright et al. | |
| 7,766,988 | B2 | 8/2010 | Roberts | |
| 7,812,557 | B2 | 10/2010 | Maekawa | |
| 7,866,061 | B2 * | 1/2011 | Tatsumi et al. | 34/595 |
| 7,908,766 | B2 * | 3/2011 | Ahn et al. | 34/595 |
| 7,921,578 | B2 | 4/2011 | McAllister et al. | |
| 8,132,339 | B2 | 3/2012 | Moon et al. | |
| 8,240,064 | B2 | 8/2012 | Steffens | |
| 8,245,545 | B2 | 8/2012 | Maekawa | |
| 8,266,824 | B2 | 9/2012 | Steiner | |
| 8,353,114 | B2 | 1/2013 | Beers et al. | |
| 8,387,273 | B2 | 3/2013 | Driussi | |
| 2006/0179676 | A1 | 8/2006 | Goldberg et al. | |
| 2006/0207299 | A1 | 9/2006 | Okazaki et al. | |
| 2006/0218812 | A1 | 10/2006 | Brown | |
| 2007/0017113 | A1 | 1/2007 | Scharpf et al. | |
| 2007/0107255 | A1 * | 5/2007 | Tamura et al. | 34/475 |
| 2008/0235977 | A1 | 10/2008 | Kuwabara | |
| 2009/0100702 | A1 | 4/2009 | Fair | |
| 2009/0139107 | A1 | 6/2009 | Grunert et al. | |
| 2009/0172969 | A1 | 7/2009 | Kim | |
| 2009/0255142 | A1 | 10/2009 | Brown | |
| 2010/0018228 | A1 | 1/2010 | Flammang et al. | |
| 2010/0070103 | A1 | 3/2010 | Fleck et al. | |
| 2010/0219183 | A1 | 9/2010 | Azancot et al. | |
| 2010/0219693 | A1 | 9/2010 | Azanvot et al. | |
| 2010/0307018 | A1 | 12/2010 | Driussi | |
| 2011/0063126 | A1 | 3/2011 | Kennedy et al. | |
| 2011/0203300 | A1 | 8/2011 | Rafalovich | |
| 2011/0314805 | A1 | 12/2011 | Seale et al. | |
| 2012/0017465 | A1 | 1/2012 | Beers et al. | |
| 2012/0073062 | A1 | 3/2012 | Farid et al. | |
| 2012/0102781 | A1 | 5/2012 | Beers et al. | |
| 2012/0197562 | A1 | 8/2012 | Scelzi et al. | |
| 2012/0203380 | A1 | 8/2012 | Scelzi et al. | |
| 2012/0204587 | A1 | 8/2012 | Zamir | |
| 2012/0272689 | A1 | 11/2012 | Elger et al. | |
| 2012/0292008 | A1 | 11/2012 | Goldberg | |
| 2013/0008049 | A1 | 1/2013 | Patil | |

FOREIGN PATENT DOCUMENTS

| | | | |
|---|---|---|---|
| DE | 4434205 | A1 | 3/1996 |
| EP | 0 094 356 | A1 | 11/1983 |
| EP | 0467188 | A1 | 1/1992 |
| EP | 1209277 | A2 | 5/2002 |
| EP | 1 959 047 | A1 | 8/2006 |
| EP | 2 077 350 | A1 | 7/2009 |
| JP | 6-63298 | A | 7/1994 |
| JP | 6-205892 | A | 7/1994 |
| JP | 07178289 | A | 7/1995 |
| JP | 2004089413 | A | 3/2004 |
| JP | 2008-173330 | A | 7/2008 |
| JP | 2008-183298 | | 8/2008 |
| WO | 9405846 | A1 | 3/1994 |
| WO | 2007/074040 | A1 | 7/2007 |
| WO | 2007074040 | A1 | 7/2007 |
| WO | 2008/138779 | A2 | 11/2008 |
| WO | 2009/015919 | A1 | 2/2009 |
| WO | 2009/106150 | A1 | 9/2009 |

* cited by examiner

APPARATUS AND METHOD FOR DRY CYCLE COMPLETION CONTROL IN HEAT PUMP DRYER BY DECLINING CAPACITY INDICATION BY ROLLING AVERAGE COMPRESSOR WATTS OR HEAT EXCHANGER PRESSURE OR TEMPERATURE

CROSS-REFERENCE TO RELATED APPLICATIONS

This is a continuation in part application of U.S. patent application Ser. No. 12/843,148, filed on Jul. 26, 2010, the entire content of which is incorporated herein by reference.

BACKGROUND OF THE INVENTION

The subject matter disclosed herein relates to appliances using a mechanical refrigeration cycle, and more particularly to heat pump dryers and the like.

Clothes dryers have typically used electric resistance heaters or gas burners to warm air to be used for drying clothes. These dryers typically work on an open cycle, wherein the air that has passed through the drum and absorbed moisture from the clothes is exhausted to ambient. More recently, there has been interest in heat pump dryers operating on a closed cycle, wherein the air that has passed through the drum and absorbed moisture from the clothes is dried, re-heated, and re-used.

In a clothes dryer, it is desirable to know when the clothes have achieved a desired level of dryness, so that the dyer can be shut down. Current systems rely on a capacitance reading between two electrodes, known as dry rods. Such systems typically stop producing a usable signal before the point when the clothes are completely dry, so that some approximation is necessary to anticipate when the clothes will actually be dry.

BRIEF DESCRIPTION OF THE INVENTION

As described herein, the exemplary embodiments of the present invention overcome one or more disadvantages known in the art.

One aspect of the present invention relates to a method comprising the steps of: in a heat pump clothes dryer operating on a mechanical refrigeration cycle, monitoring, as a function of time, at least one parameter, the at least one parameter in turn comprising at least one of: working fluid temperature; working fluid pressure; and compressor power; based on the monitoring, determining whether the at least one parameter monitored as the function of time reaches a predetermined decision condition; and, if the at least one parameter monitored as the function of time reaches the predetermined decision condition, powering down the mechanical refrigeration cycle.

Another aspect relates to an apparatus comprising: a mechanical refrigeration cycle arrangement having a working fluid and an evaporator, a condenser, a compressor, and an expansion device, cooperatively interconnected and containing the working fluid; a drum to receive clothes to be dried; and a duct and fan arrangement configured to pass air over the condenser and through the drum. The apparatus further comprises a sensor located to sense at least one parameter. The at least one parameter includes at least one of temperature of the working fluid, pressure of the working fluid, and power consumption of the compressor. The apparatus still further comprises a controller coupled to the sensor and the compressor. The controller is operative to: monitor, as a function of time, the at least one parameter; based on the monitoring, determine whether the at least one parameter monitored as the function of time reaches a predetermined decision condition; and, if the at least one parameter monitored as the function of time reaches the predetermined decision condition, power down the mechanical refrigeration cycle at least by causing the compressor to shut off.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

Figure 1:
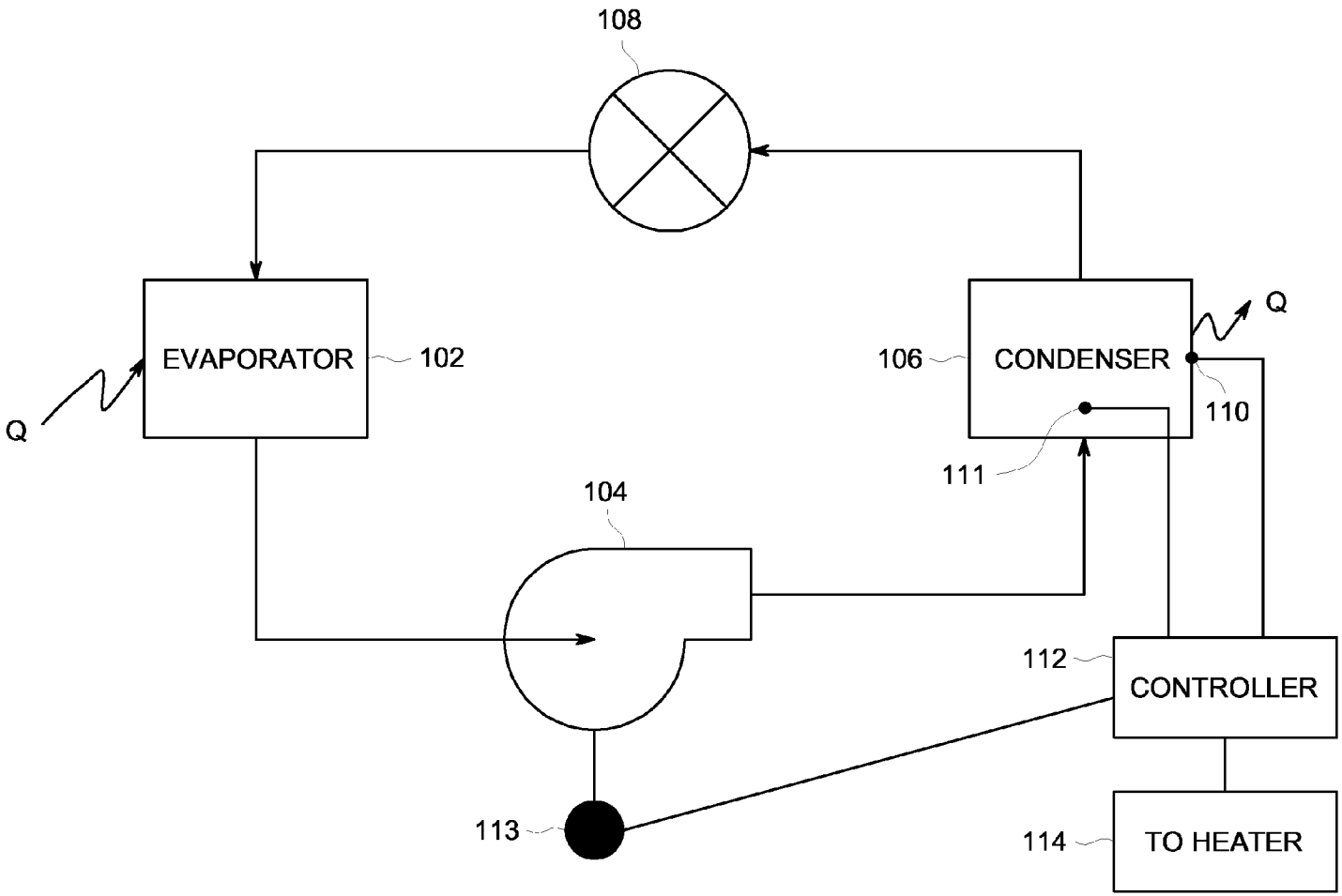
FIG. 1 is a block diagram of an exemplary mechanical refrigeration cycle, in accordance with a non-limiting exemplary embodiment of the invention.

FIG. 1 shows an exemplary embodiment of a mechanical refrigeration cycle, in accordance with an embodiment of the invention. Heat (Q) flows into evaporator 102, causing refrigerant flowing through same to evaporate and become somewhat superheated. The superheated vapor is then compressed in compressor 104, and flows to condenser 106, where heat (Q) flows out. The refrigerant flowing through condenser 106 condenses and becomes somewhat sub-cooled. It then flows through restriction 108 and back to evaporator 102, competing the cycle. In a refrigerator, freezer, or air conditioner, evaporator 102 is located in a region to be cooled, and heat is generally rejected from condenser 106 to ambient. In a heat pump, heat is absorbed from the ambient in evaporator 102 and rejected in condenser 106 to a space to be heated.

In the non-limiting exemplary embodiment of FIG. 1, a temperature or pressure sensor 110 is located in the center of the condenser 106 and is coupled to a controller 112 which, as indicated at 114, in turn controls an auxiliary heater, to be discussed in connection with FIG. 2.

In review, a mechanical refrigeration system includes the compressor 104 and the restriction 108 (either a capillary or a thermostatic expansion valve or some other kind of expansion valve or orifice—a mass flow device just before the evaporator 102 which limits the mass flow and produces the pressures in the low side and high side). The condenser 106 and the evaporator 102 are heat exchange devices and they regulate the pressures. The mass transfer devices 104, 108 regulate the mass flow. The pressure in the middle of the condenser 106 will be slightly less than at the compressor outlet due to flow losses.

Figure 2:
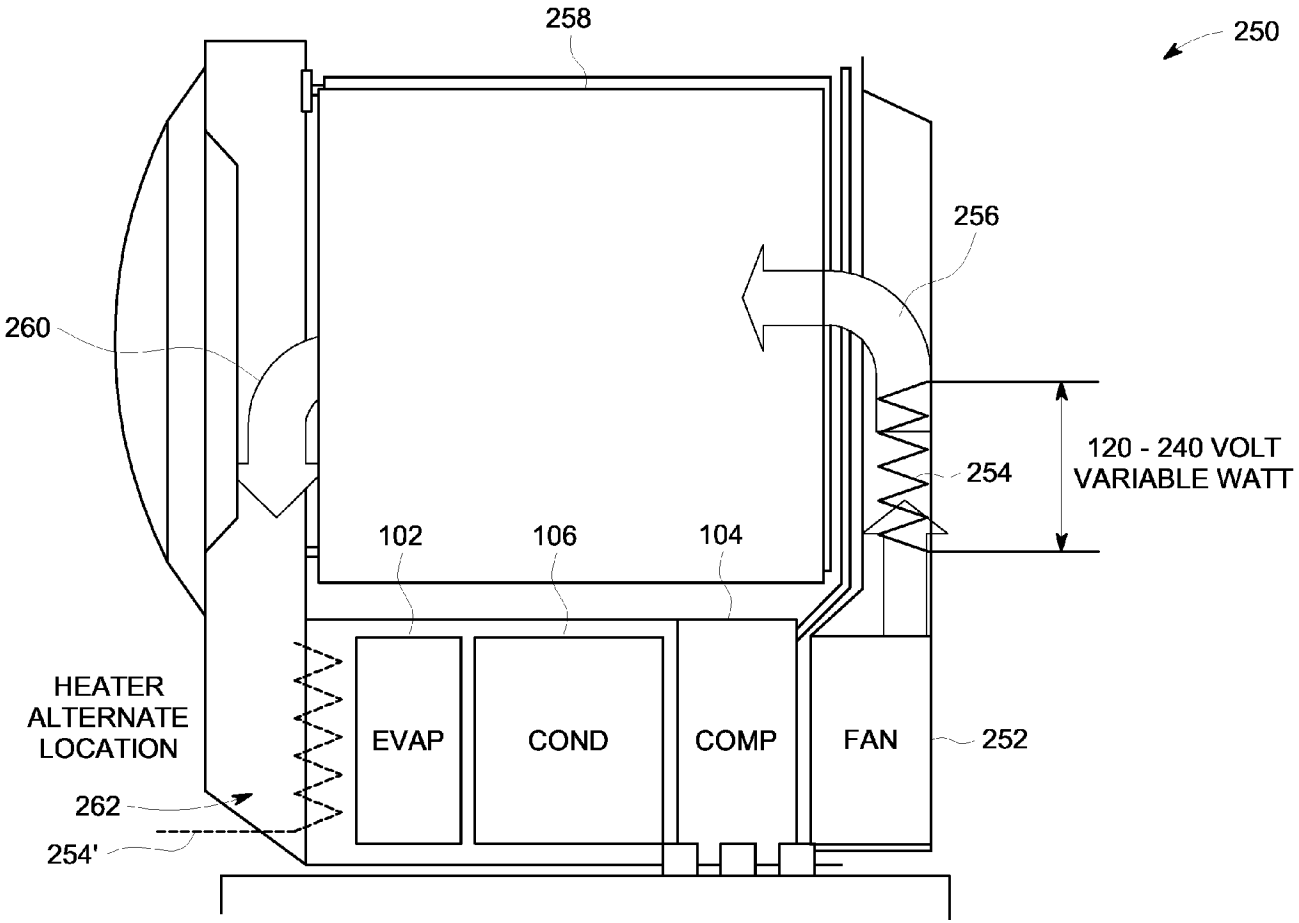
FIG. 2 is a semi-schematic side view of a heat pump dryer, in accordance with a non-limiting exemplary embodiment of the invention.

FIG. 2 shows an exemplary embodiment of a heat pump type clothes dryer 250. The evaporator 102, condenser 106, and compressor 104 are as described above with respect to FIG. 1. The refrigerant lines and the expansion valve 108 are omitted for clarity. Fan 252 circulates air through a supply duct 256 into drum 258 to dry clothes contained therein. The mechanism for rotating the drum 258 can be of a conventional kind and is omitted for clarity. Air passes through the drum 258 into a suitable return plenum 260 and then flows through a return duct 262. Condenser 106 is located in the air path to heat the air so that it can dry the clothes in the drum 258.

One or more embodiments include an auxiliary heater 254 in supply duct 256 and/or an auxiliary heater 254' in return duct 262; in either case, the heater may be controlled by controller 112 as discussed elsewhere herein.

One or more embodiments advantageously improve transient performance during start-up of a clothes dryer, such as dryer 250, which works with a heat pump cycle rather than electric resistance or gas heating. As described with respect to 254, 254', an auxiliary heater is placed in the supply and/or return duct and used to impact various aspects of the startup transient in the heat pump drying cycle.

With continued reference to FIG. 1, again, compressor 104 increases the pressure of the refrigerant which enters the condenser 106 where heat is liberated from the refrigerant into the air being passed over the condenser coils. The fan 252 passes that air through the drum 258 to dry the clothes. The air passes through the drum 258 to the return duct 262 and re-enters or passes through the evaporator 102 where it is cooled and dehumidified (this is a closed cycle wherein the drying air is re-used). In some instances, the heater can be located as at 254, in the supply duct to the drum (after the fan 252 or between the condenser 106 and the fan 252). In other instances, the heater can be located at point 254', in the return duct from the drum 258, just before the evaporator 102.

Thus, one or more embodiments place a resistance heater of various wattage in the supply or return duct of a heat pump dryer to provide an artificial load through the drum 258 to the evaporator 102 by heating the supply and therefore the return air, constituting a sensible load to the evaporator 102 before the condenser 106 is able to provide a sensible load or the clothes load in drum 258 is able to provide a latent psychrometric load. This forces the system to develop higher temperatures and pressures earlier in the run cycle, accelerating the onset of drying performance.

A refrigeration system normally is run in a cycling mode. In the off cycle it is allowed to come to equilibrium with its surroundings. A system placed in an ambient or room type environment will seek room temperature and be at equilibrium with the room. When the system is subsequently restarted, the condenser and evaporator will move in opposite directions from the equilibrium pressure and temperature. Thus, the evaporator will tend towards a lower pressure and/or temperature and the condenser will seek a higher temperature and/or pressure. The normal end cycle straddles the equilibrium pressure and steady state is reached quite quickly.

In one or more embodiments, for system efficiency in a heat pump dryer, operating points that result in both the condenser and evaporator pressures and temperatures being above the equilibrium pressure of the system in the off mode are sought.

Figure 3:
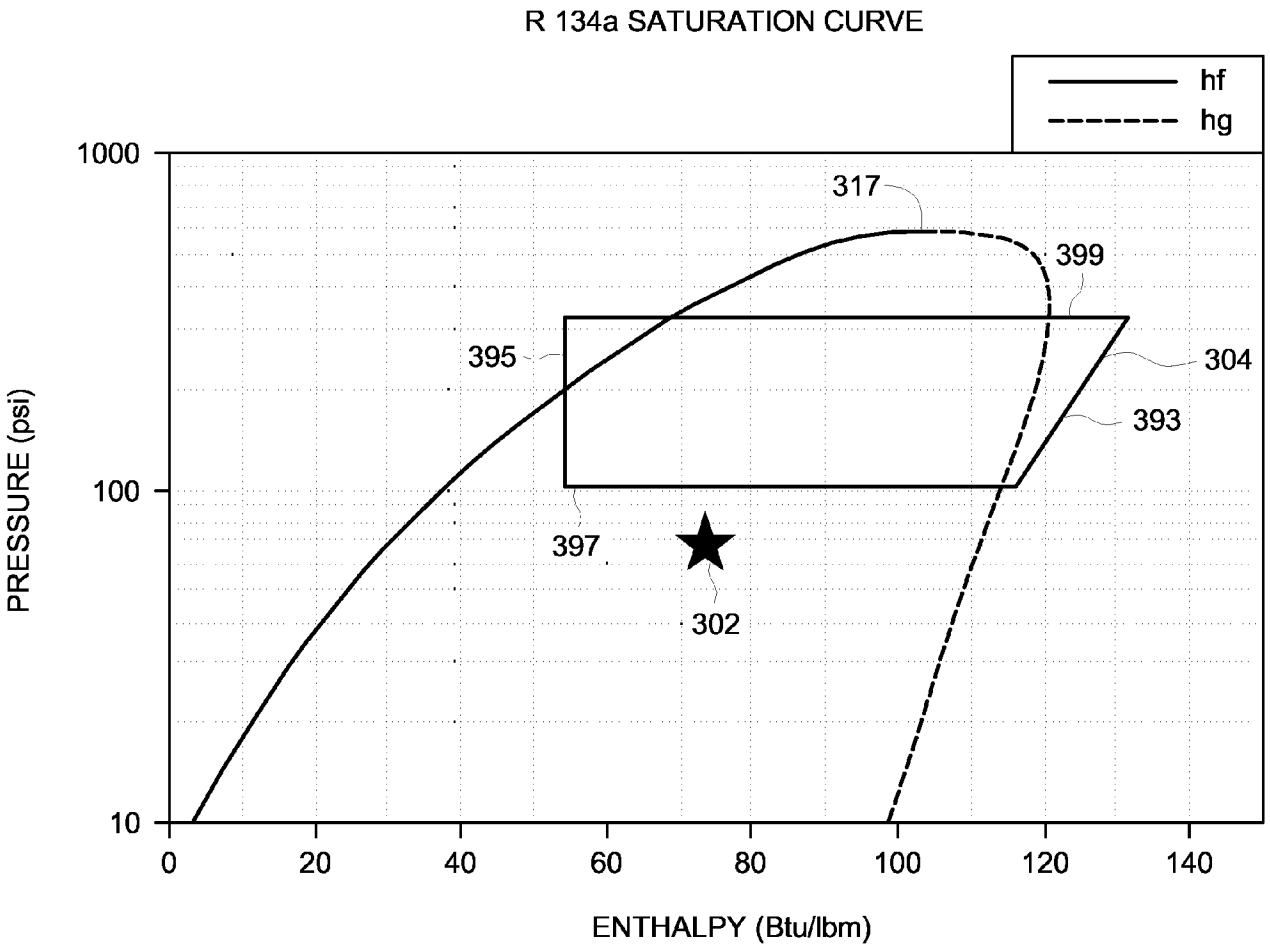
FIGS. 3 and 4 are pressure-enthalpy diagrams illustrating refrigerant cycle elevation, in accordance with a non-limiting exemplary embodiment of the invention.
Figure 4:
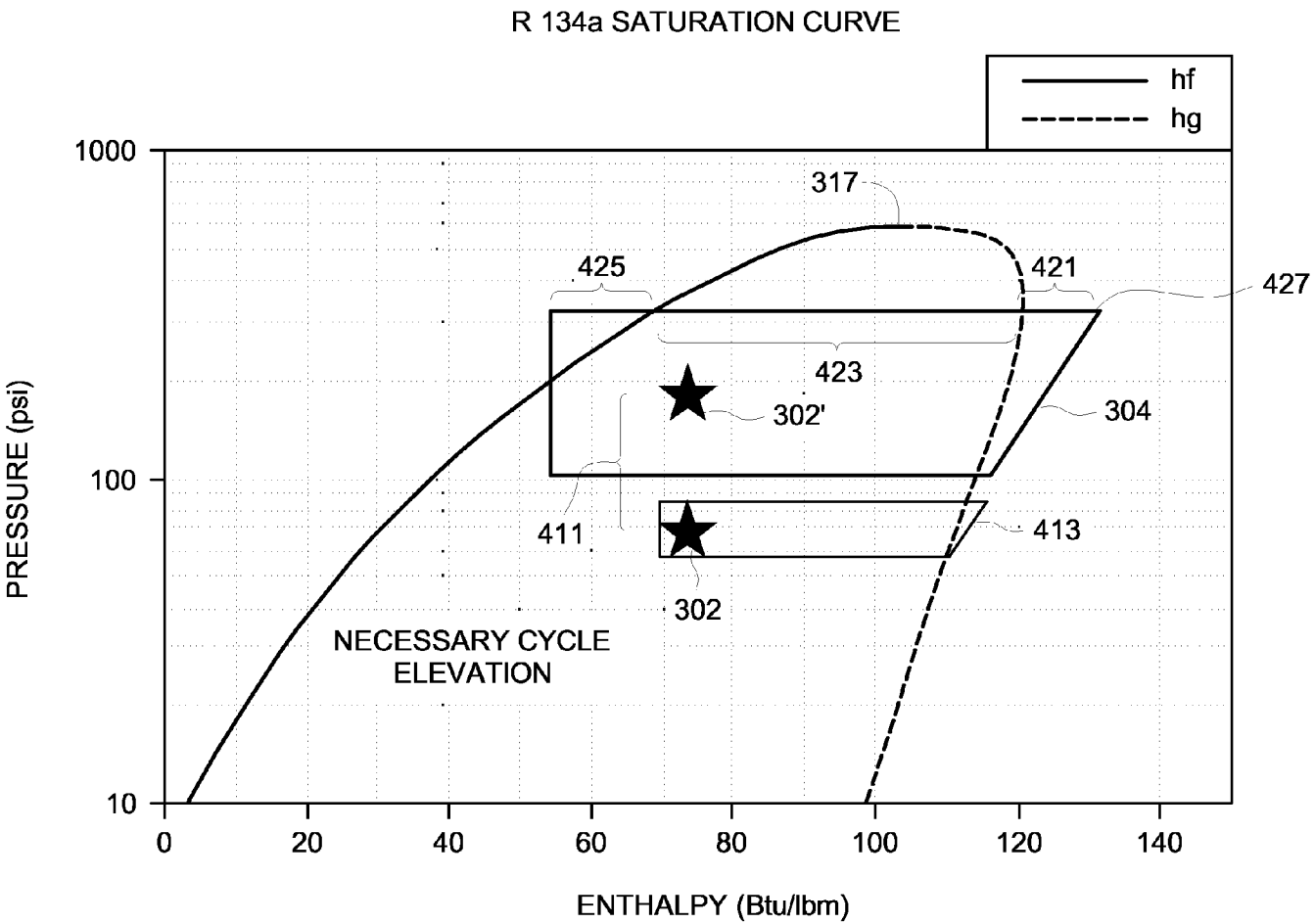

Placing a heater in the supply duct to the drum of a heat pump dryer heats the air up well above ambient temperature as it is presented to the evaporator. If the heater is on at the start of a drying cycle the heat serves to begin the water extraction process in the clothes by evaporation in combination with the airflow by diffusion. The fact that more water vapor is in the air, and the temperature is higher than would otherwise be the case, causes the evaporator to "see" higher temperature than it would otherwise "see." The temperature of the evaporator will elevate to meet the perceived load, taking the pressure with it. Thus the temperature and pressure of the refrigerant are elevated above the ambient the refrigerant would otherwise seek as shown in FIGS. 3 and 4 and described in greater detail below.

With each subsequent recirculation of the air, a higher level is reached until leakage and losses neutralize the elevating effects. Since a suitably sealed and insulated system will not lose the accumulated heat, the cycle pressure elevation can continue until a quite high pressure and temperature are reached. Thus, the refrigeration system moves into a regime where compressor mass flow is quite high and power consumed is quite low.

With the heater on, the system moves to a higher total average pressure and achieves such a state considerably faster than in a conventional system. This is brought about by supplying the evaporator a definite and instantaneous load. This loading causes the heat exchangers (i.e., evaporator 102 and condenser 106) to react and supply better properties to accelerate mass flow through the mass flow devices (the compressor 104 and restrictor 108).

Elevation of a refrigerant cycle's pressures within the tolerance limits of the refrigerant boosts compressor capacity at approximately equal power consumption. Thus, in one or more embodiments, the efficiency of refrigeration cycles is improved as pressures are elevated.

Given the teachings herein, the skilled artisan will be able to install, control, and protect a suitable heater with minimal cost, and will also be able to interconnect the heater with the control unit for effective control.

Refer to the P-h (pressure-enthalpy) diagram of FIG. 3. The star 302 represents the equalization condition. In refrigerators and other refrigeration devices such as air conditioners, dehumidifiers, and the like, a cycle is typically started up around the equalization point. When the compressor starts, it transfers mass from the evaporator or low pressure side, to the high pressure side (condenser). The condenser rejects heat and the evaporator absorbs heat, as described above. Generally, the source temperatures for the heat exchangers are found inside the cycle curve 304. The diagram of FIG. 3 illustrates, rather than lowering (the evaporator pressure) and raising (the condenser pressure) pressures from equilibrium, elevating the cycle 304 completely (i.e., both low 397 and high 399 pressure sides) above the equalization pressure at star 302. To accomplish this, provide the aforementioned auxiliary heat source to raise the cycle to a different starting state by preloading the evaporator and causing the system to migrate to a higher pressure-temperature cycle.

Refer now to the P-h diagram of FIG. 4. The necessary cycle elevation is given by the bracket 411 between the two stars 302, 302'. Typically, the system will start in a cycle 413 surrounding the equalization point, which is the lower star 302. Because of the auxiliary heater (which in one or more embodiments need provide only a faction of the power actually needed to dry the clothes), the cycle elevates and spreads to the desired upper envelope 304. By way of review, if the auxiliary heater was not applied, operation would be within the lower cycle 413 wherein, shortly after startup, the upper pressure is between 80 and 90 PSI and the lower pressure is between 50 and 60 PSI. Note that these values would eventually change to an upper pressure of about 150 PSI and a lower pressure of about 15 PSI when a steady state was reached. Thus, without the extra heater, the steady state cycle obtained would have a high side pressure of about 150 PSI and a low side pressure of about 15 PSI. Upper envelope 304 shows the results obtained when the auxiliary heater is used. Eventually, the auxiliary heater is preferably shut off to prevent the compressor overheating. Thus, for some period of time during the startup transient, apply extra heat with the auxiliary heater, causing the heat pump to operate in a different regime with a higher level of pressure.

For completeness, note that upper envelope 304 represents, at 393, a compression in compressor 104; at high side 399, condensation and sub-cooling in condenser 106; at 395, an isenthalpic expansion through valve 108, and at low side 397, evaporation in evaporator 102. Enter the condenser as a superheated vapor; give up sensible heat in region 421 until saturation is reached, then remain saturated in region 423 as the quality (fraction of the total mass in a vapor-liquid system that is in the vapor phase) decreases until all the refrigerant has condensed; then enters a sub-cooled liquid region 425.

Heretofore, it has been known to place resistance heaters in the supply (but not return) ducts of heat pump dryers simply to supplement the action of the condenser in heating and drying the air. However, one or more embodiments of the invention control the heater to achieve the desired thermodynamic state of the refrigeration cycle and then shut the heater off at the appropriate time (and/or cycle the heater). With reference to FIG. 4, $h_f$ and $h_g$ are, respectively, the saturated enthalpies of the fluid and gas. When operating at full temperature and pressure, the high side 399 (line of constant pressure) is at approximately 300 PSI, which is very close to the top 317 of the vapor dome curve. At such point, effectiveness of the heat exchanger will be lost, so it is not desirable to keep raising the high side pressure.

Furthermore, at these very high pressures, the compressor is working very hard and may be generating so much heat at the power at which it is running that the compressor temperature increases sufficiently that the thermal protection device on the compressor shuts the compressor off. In one or more embodiments, employ a sensor 110, such as a pressure transducer and/or a thermal measurement device (e.g., a thermocouple or a thermistor) and monitor the high side temperature and/or the high side pressure. When they reach a certain value which it is not desired to exceed, a controller 112 (for example, an electronic control) turns the heater off.

To re-state, a pressure transducer or a temperature sensor is located in the high side, preferably in the middle of the condenser (but preferably not at the very entrance thereof, where superheated vapor is present, and not at the very outlet thereof, where sub-cooled liquid is present). The center of the condenser is typically operating in two phase flow, and other regions may change more quickly than the center of the condenser (which tends to be quite stable and repeatable). Other high side points can be used if correlations exist or are developed, but the center of the condenser is preferred because of its stability and repeatability (that is, it moves up at the rate the cycle is moving up and not at the rate of other transients associated with the fringes of the heat exchanger). Thus, one or more embodiments involve sensing at least one of a high side temperature and a high side pressure; optionally but preferably in the middle of the condenser.

Comments will now be provided on the exemplary selection of the pressure or temperature at which the auxiliary heater is turned off. There are several factors of interest. First, the compressor pressure can reach almost 360 or 370 PSI, and the compressor will still function, before generating enough heat such that the thermal protection device shuts it off, as described above. This, however, is typically not the limiting condition; rather, the limiting condition is the oil temperature. The compressor lubricating oil begins to break down above about 220 degrees F. (temperature of the shell, oil sump, or any intermediate point in the refrigerant circuit). Initially, the oil will generate corrosive chemicals which can potentially harm the mechanism; furthermore, the lubricating properties are lost, which can ultimately cause the compressor to seize up. In one or more embodiments, limit the condenser mid temperature to no more than 190 degrees F., preferably no more than 180 degrees F., and most preferably no more than 170 degrees F. In this manner, when the heater is shut off, the compressor will stabilize at a point below where any of its shell or hardware temperatures approach the oil decomposition temperature. With regard to discharge temperature, note that point 427 will typically be about 210 degrees F. when the high side pressure is at about 320 PSI. The saturation temperature at that pressure (middle of the condenser) will be about 170 degrees F. and therefore control can be based on the mid-condenser temperature. The compressor discharge 427 is typically the hottest point in the thermodynamic cycle. The discharge is a superheated gas. The discharge gas then goes through a convective temperature change (FIG. 4 reference character 421 temperature drop) until the constant "condensing temperature" is reached. This is most accurately measured in the center of the condenser. Oil is heated by contact with the refrigerant and by contact with metal surfaces in the compressor. Generally the metal parts of the inside of the compressor run 20-30 degrees F. above the hottest point measured on the outside. The actual temperature to stay below is, in one or more embodiments, 250 degrees F. Thus, there is about a 10 degree F. margin worst case. In one or more embodiments, when the cycle is run up to this point, the maximum capacity is obtained at minimum energy, without causing any destructive condition in the compressor. Heretofore, compressors have not been operated in this region because compressor companies typically will not warrant their compressors in this region.

As noted, prior techniques using a heater do so to provide auxiliary drying capacity, not for system operating point modification, and do not carry out any sensing to turn the heater off. One or more embodiments provide a sensor 110 and a controller 112 that shut off the heater 254, 254' at a predetermined point, as well as a method including the step of shutting off the heater at a predetermined point.

Any kind of heater can be used. Currently preferred are twisted Nichrome wire (nickel-chromium high-resistance heater wire) ribbon heaters available from industrial catalogs, commonly used in hair dryers and the like.

Figure 5:
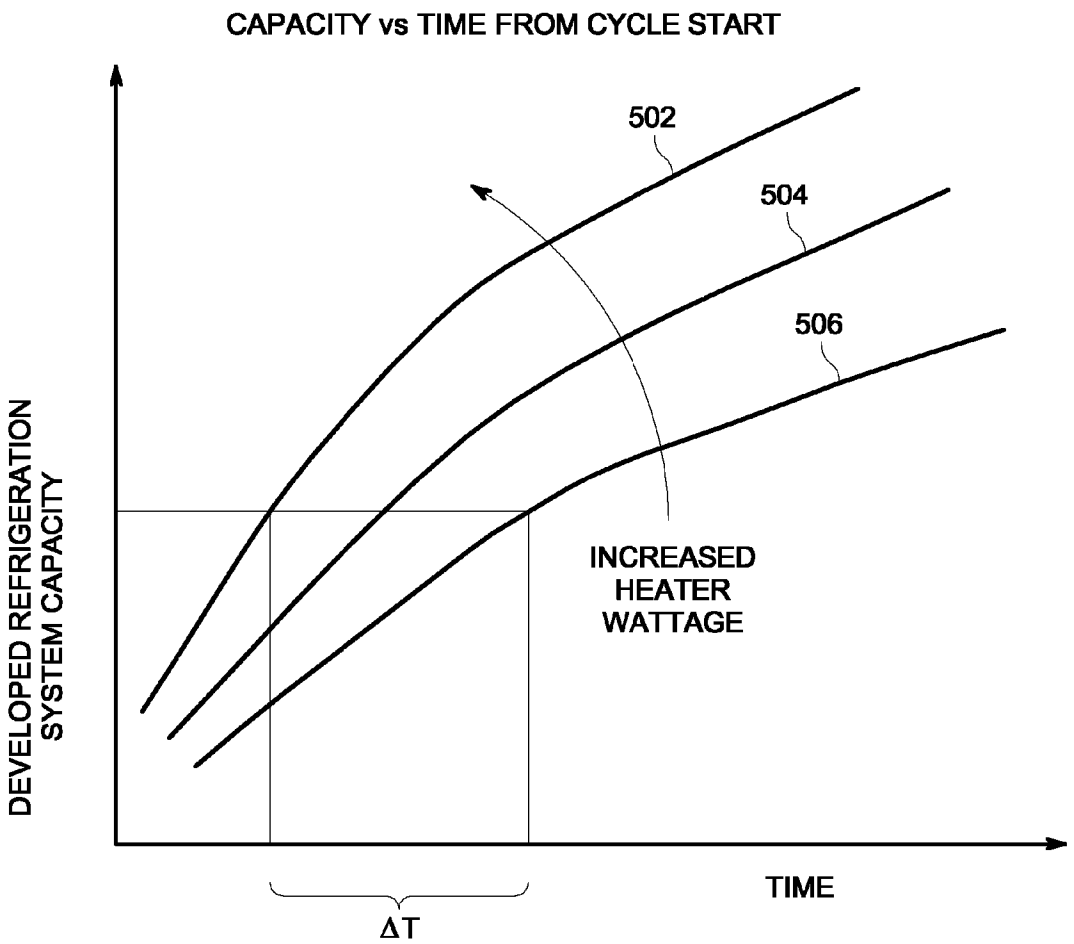
FIG. 5 presents capacity rise curves for a refrigeration system operating at elevated state points, in accordance with a non-limiting exemplary embodiment of the invention.

With the desired ending cycle for a heat pump dryer at a significant elevation above the normal air conditioning state points the transient for cycle elevation is quite long. The application of an external heater 254, 254' accelerates that transient. The observed effect is directly proportional to heater power. That is, the more power input to the auxiliary heater, the faster effective capacity and total system capacity are developed. Refer to FIG. 5, which depicts capacity rise curves of a refrigeration system operating at elevated state points with an auxiliary heater in the air circuit. The rate of capacity rise is proportional to power applied.

The faster onset of effective capacity accelerates the drying process and reduces drying time. With the heater on, the system not only moves to a higher total average pressure (and thus temperature), but also gets there significantly faster.

Thus, in one or more embodiments, application of an independent heat source to a heat pump airside circuit accelerates the progress of a refrigeration system to both effective capacity ranges and final desired state points.

Any one, some, or all of four discrete beneficial effects of the auxiliary heater can be realized in one or more embodiments. These include: (1) total amount of heat transfer attainable; (2) rate at which system can come up to full capacity; (3) cycle elevation to obtain a different state than is normally available; and (4) drying cycle acceleration.

With regard to point (2), capacity, i.e., the time it takes to get to any given capacity—it has been found that this is related to the heater and the size of the heater. In FIG. 5, time is on the lower (X) axis and capacity is on the vertical (Y) axis. Recall that with the heater elevating the system operating point, it is possible to operate at 2-3 times the rated value. The rated power of a compressor is determined by running a high back pressure compressor (air conditioning) typically at about 40 degrees F. evaporating temperature and about 131 degrees F. condensing temperature. At this rating point the rated value for an exemplary compressor is about 5000 or 7000 Btu/hr. Elevated pressures in accordance with one or more embodiments will make the compressor able to pump about 12000 or 15000 Btu/hr. This is why it is advantageous to elevate the system operating state points, to get the extra capacity. The power (wattage) of the heater also determines how fast these extra-rated values can be obtained. FIG. 5 shows the start-up curves of developed capacity versus time. With the heater in the system, it is possible to obtain more capacity faster by increasing the heater wattage.

One aspect relates to the final selection of the heater component to be installed in the drier. Thus, one or more embodiments provide a method of sizing a heater for use in a heat pump drier. The capacity ("Y") axis reads "developed refrigeration system capacity" as it does not refer to the extra heating properties of the heater itself, but rather how fast the use of the heater lets the refrigerant system generate heating and dehumidifying capacity. Prior art systems dry clothes with the electric heat as opposed to accelerating the refrigerating system coming up to full capacity. The size of the heater that is eventually chosen can help determine how fast the system achieves full capacity—optimization can be carried out between the additional wattage of the heater (and thus its power draw) and the capacity (and power draw) of the refrigeration system. There will be some optimum; if the heater is too large, while the system will rapidly come up to capacity, more total energy will be consumed than at the optimum point, due to the large heater size, whereas if the heater is too small, the system will only slowly come up to capacity, requiring more power in the refrigeration system, and again more energy will be consumed than at the optimum point. This effect can be quantified as follows. The operation of the heater involves adding power consumption for the purpose of accelerating system operation to minimize dry time. It has been determined that, in one or more embodiments, there does not appear to be a point at which the energy saved by shortening the dry time exceeds the energy expended in the longer cycle. Rather, in one or more embodiments, the total power to dry, over a practical range of heater wattages, monotonically increases with heater power rating while the efficiency of the unit monotonically decreases with heater wattage. That is to say that, in one or more embodiments, the unit never experiences a minima where the unit saves more energy by running a heater and shortening time rather than not. Thus, in one or more embodiments, the operation of a heater is a tradeoff based on desired product performance of dry time vs. total energy consumption.

In another aspect, upper line 502 represents a case where compressor power added to heater power is greater than the middle line 504. Lower line 506 could represent a case where compressor power plus heater power is less than middle line 504 but the time required to dry clothes is too long. Center line 504 represents an optimum of shortest time at minimum power. In other words, for curve 504, power is lowest for maximum acceptable time. Lower line 506 may also consume more energy, as described above, because the compressor would not be operating as efficiently.

Figure 6:
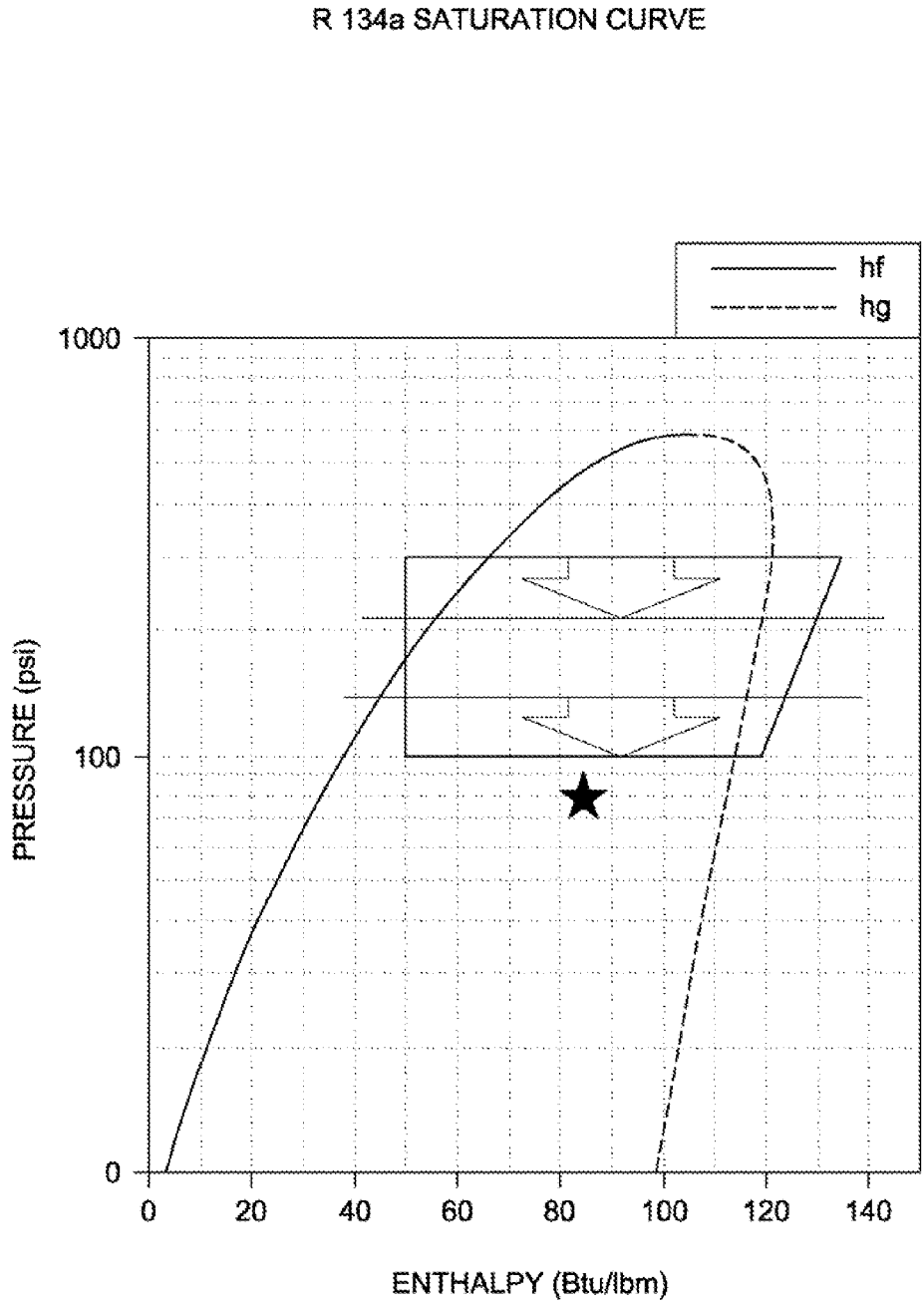
FIG. 6 is a pressure-enthalpy diagram illustrating a basic vapor compression cycle is in thermal and mass flow balance until an external source causes the balance to be upset, in accordance with a non-limiting exemplary embodiment of the invention.

As shown in FIG. 6, a basic vapor compression cycle is in thermal and mass flow balance until an external source causes the balance to be upset.

Figure 7:
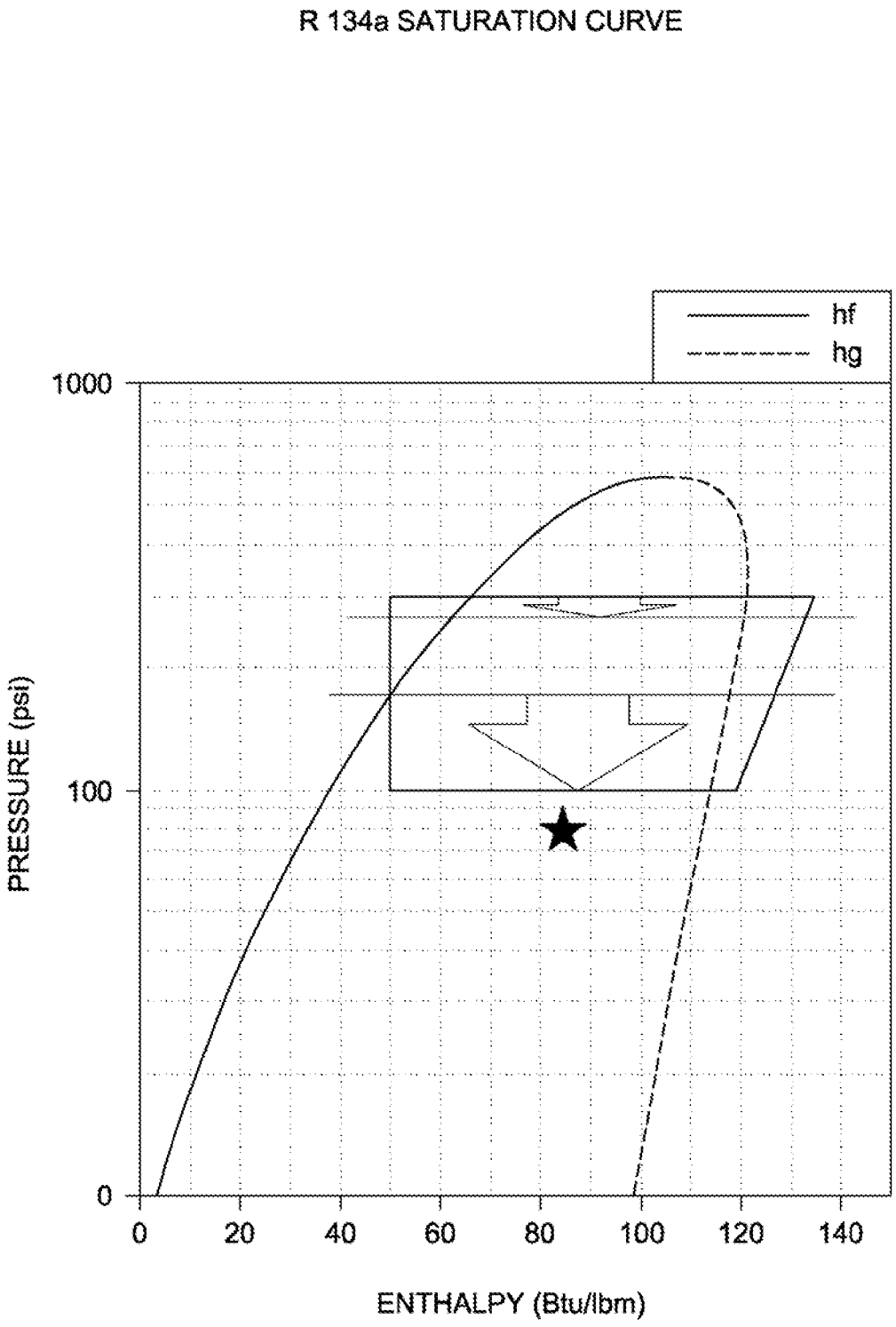
FIG. 7 is a pressure-enthalpy diagram illustrating temperature shift from auxiliary heating causes heat transfer imbalance and mass flow restriction in capillary resulting in capacity increase in evaporator, pressure elevation in condenser and mass flow imbalance, in accordance with a non-limiting exemplary embodiment of the invention.

The temperature shift from auxiliary heating causes heat transfer imbalance and mass flow restriction in the capillary (or other expansion valve) resulting in capacity increase in the evaporator and pressure elevation in the condenser. Mass flow imbalance is also a result, as seen in FIG. 7, which depicts the imbalance created by additional heat input at the evaporator by raised return temperature.

Figure 8:
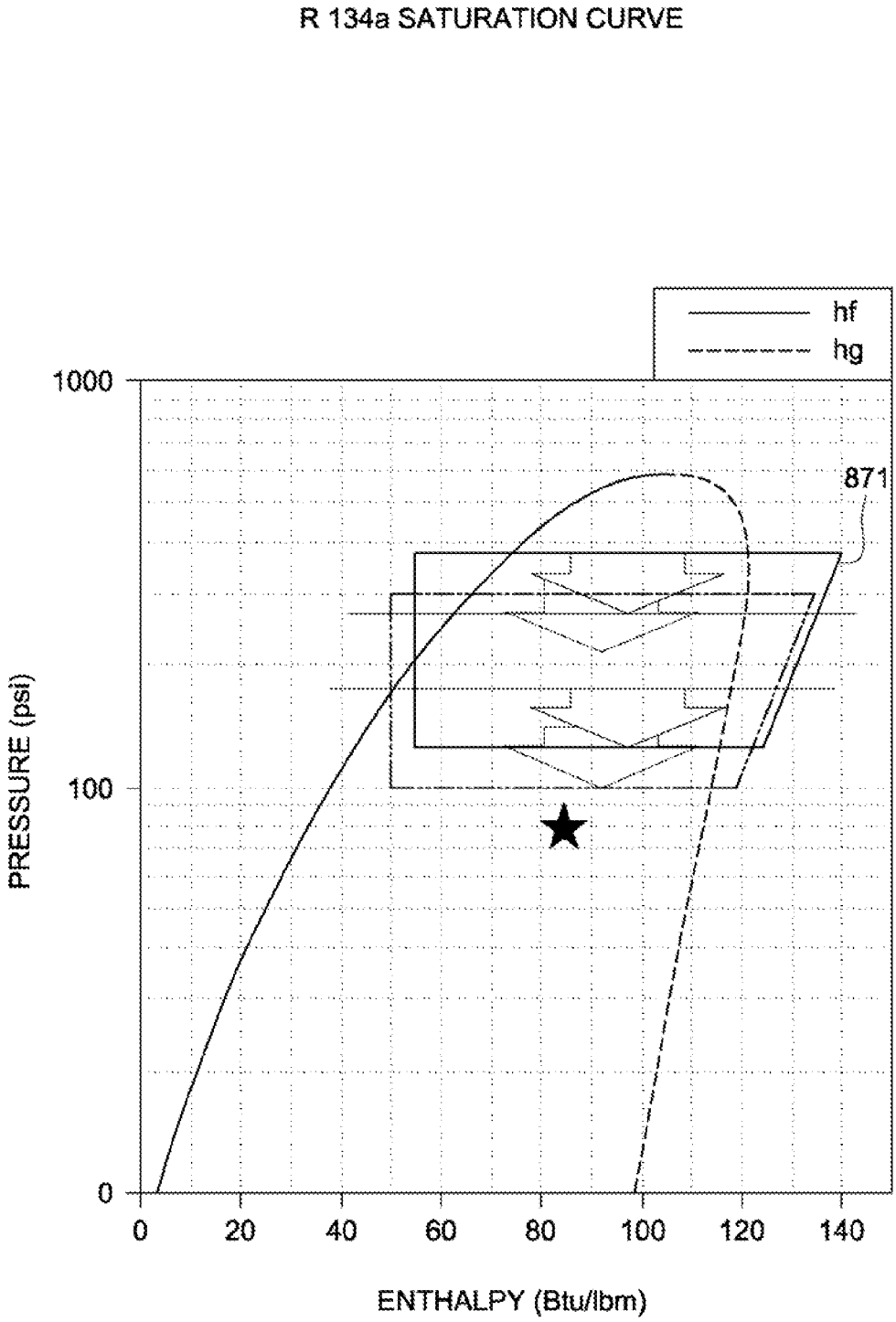
FIG. 8 is a pressure-enthalpy diagram illustrating mass flow through compressor increases due to superheating resulting in further pressure increase in condenser, the dynamic transient is completed when condenser reestablished subcooling and heat flow balance at higher pressures and the net effect is higher average heat transfer during process migration, in accordance with a non-limiting exemplary embodiment of the invention.

Mass flow through the compressor increases due to superheating resulting in further pressure increase in the condenser. The dynamic transient is completed when the condenser reestablishes sub-cooling and heat flow balance at higher pressures. The net effect is higher average heat transfer during process migration. FIG. 8 shows thermal and mass flow equilibrium reestablished at higher state points after the heat input transient.

One or more embodiments thus enable an imbalance in heat exchange by apparently larger capacity that causes more heat transfer to take place at the evaporator. The imbalance causes an apparent rise in condenser capacity in approximately equal proportion as the condensing pressure is forced upward. The combined effect is to accelerate the capacity startup transient inherent in heat pump dryers.

Experimentation has demonstrated the effect of capacity augmentation through earlier onset of humidity reduction and moisture collection in a run cycle.

Referring again to FIGS. 6-8, via the elevated cycle, it is possible to increase the capacity, inasmuch as the temperature shift from auxiliary heating causes heat transfer imbalance and mass flow restriction in the capillary (or other expansion valve) resulting in capacity increase in the evaporator and pressure elevation in the condenser. Mass flow imbalance is also a result. Furthermore, mass flow through the compressor increases due to superheating, resulting in further pressure increase in the condenser. The dynamic transient is completed when the condenser re-establishes sub-cooling and heat flow balance at higher pressures. The net effect is higher average heat transfer during process migration.

Heat is transferred by temperature difference (delta T). The high-side temperature 871 is at the top of the cycle diagram in FIG. 8. When that temperature is elevated, there is a larger delta T between the sink temperature (air to which heat is being rejected) and the actual temperature of the heat exchanger (condenser) itself. The imbalance caused by the auxiliary heater increases delta T and thus heat transfer which creates an apparent increase in capacity above that normally expected at a given condensing pressure or temperature. The effect is analogous to a shaker on a feed bowl; in effect, the heater "shakes" the refrigeration system and makes the heat move more efficiently. Again, it is to be emphasized that this is a thermodynamic effect on the heat pump cycle, not a direct heating effect on the clothes.

One or more embodiments of the invention pulse or cycle a heater in a heat pump clothes dryer to accomplish control of the heat pump's operating point. As noted above, placing a resistance heater of various wattage in the supply and/or return ducts of a heat pump dryer provides an artificial load through the drum to the evaporator by heating the supply and therefore the return air, constituting an incremental sensible load to the evaporator. This forces the system to develop higher temperatures and pressures that can cause the cycle to elevate continuously while running. In some embodiments, this can continue well past the time when desired drying performance is achieved. When the heater is turned off during a run cycle the cycle tends to stabilize without additional pressure and/or temperature rise, or even begin to decay. If the system operating points decay the original growth pattern can be repeated by simply turning the heater back on. Cycling such a heater constitutes a form of control of the capacity of the cycle and therefore the rate of drying.

As noted above, for system efficiency in a heat pump dryer, seek operating points that result in both the condenser and evaporator well above the equilibrium pressure of the system in off mode. In one or more embodiments, this elevation of the refrigeration cycle is driven by an external forcing function (i.e., heater 254, 254').

Further, in a normal refrigeration system, the source and sink of the system are normally well established and drive the migration to steady state end points by instantly supplying temperature differences. Such is not the case with a heat pump dryer, which typically behaves more like a refrigerator in startup mode where the system and the source and sink are in equilibrium with each other.

As noted above, with each subsequent recirculation of the air, a higher cycle level is reached until leakage and losses neutralize the elevating effects. Since a properly sealed and insulated system will not lose this accumulated heat, the cycle pressure elevation can continue until quite high pressure and temperature are reached. Thus, the refrigeration system moves into a regime where compressor mass flow is quite high and power consumed is quite low. However, a properly sealed and insulated system will proceed to high enough head pressures to shut off the compressor or lead to other undesirable consequences. In one or more embodiments, before this undesirable state is reached, the heater is turned off, and then the system states begin to decay and or stabilize. In one or more embodiments, control unit 112 controls the heater in a cycling or pulse mode, so that the system capacity can essentially be held constant at whatever state points are desired.

One or more embodiments thus provide capacity and state point control to prevent over-temperature or over-pressure conditions that can be harmful to system components or frustrate consumer satisfaction.

Figure 9:
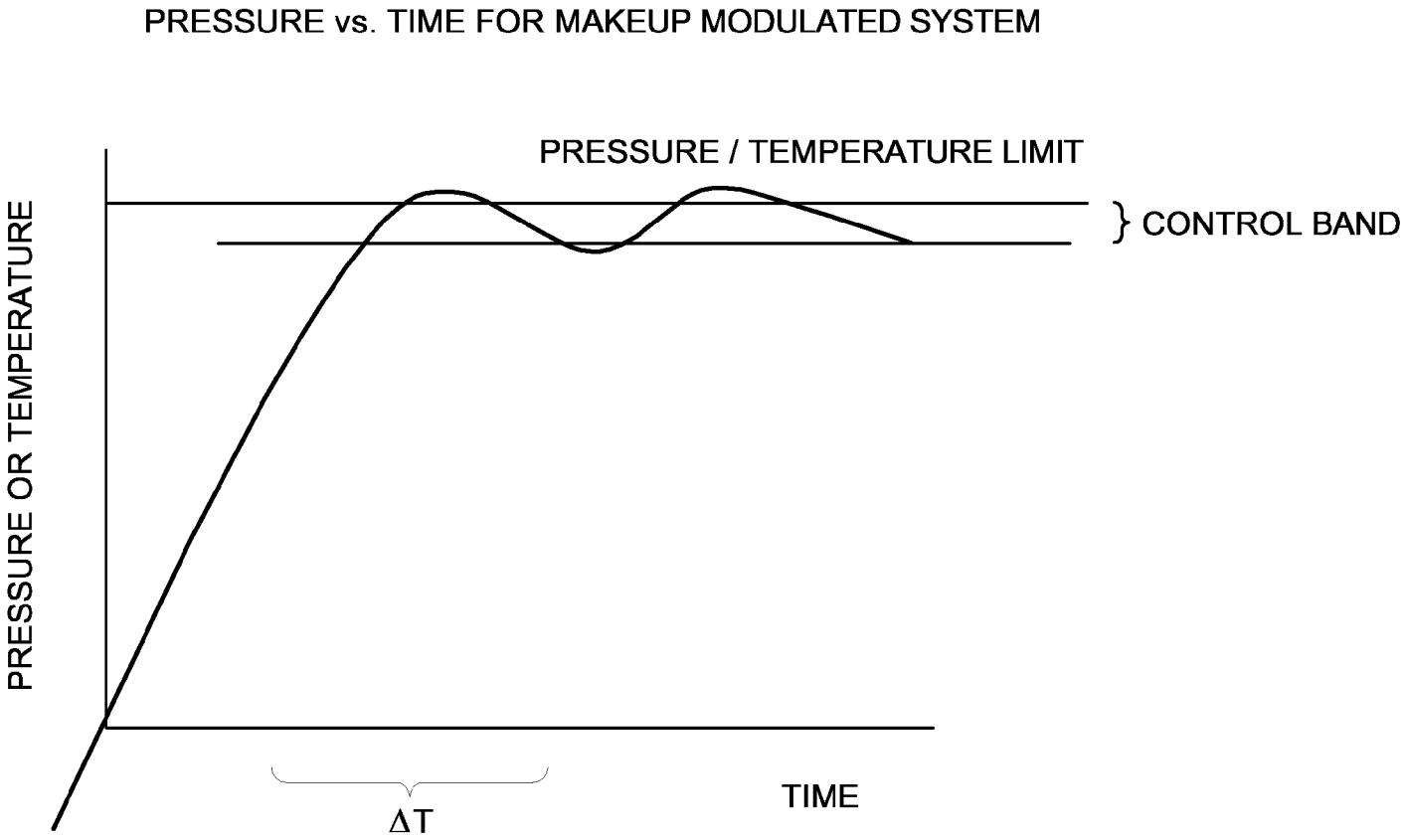
FIG. 9 presents pressure versus time for a cycle wherein an auxiliary heater is pulsed, in accordance with a non-limiting exemplary embodiment of the invention.

With reference now to FIG. 9, it is possible to accelerate the time in which the system comes up to full capacity. Once the system comes up to full capacity, then it is desired to ensure that the compressor is not overstressed. In some embodiments, simply turn off the heater when the temperature and/or pressure limits are reached (e.g., above-discussed temperature limits on compressor and its lubricant). In other cases, the heater can be cycle back on and off during the drying cycle. In the example of FIG. 9, the heater is cycled within the control band to keep the system at an elevated state.

Accordingly, some embodiments cycle the heater to keep the temperature elevated to achieve full capacity. By way of review, in one aspect, place a pressure or temperature transducer in the middle of the condenser and keep the heater on until a desired temperature or pressure is achieved. In other cases, carry this procedure out as well, but selectively turn the heater back on again if the temperature or pressure transducer indicates that the temperature or pressure has dropped off.

Determination of a control band is based on the sensitivity of the sensor, converter and activation device and the dynamic behavior of the system. These are design activities separate from the operation of the principle selection of a control point. Typically, in a control, a desired set point or comfort point is determined (e.g., 72 degrees F. for an air conditioning application). Various types of controls can be employed: electro-mechanical, electronic, hybrid electro-mechanical, and the like; all can be used to operate near the desired set or comfort point. The selection of dead bands and set points to keep the net average temperature at the desired value are within the capabilities of the skilled artisan, given the teachings herein. For example, an electromechanical control for a room may employ a 7-10 degree F. dead band whereas a 3-4 degree F. dead band might be used with an electronic control. To obtain the desired condenser mid temperature, the skilled artisan, given the teaching herein, can set a suitable control band. A thermistor, mercury contact switch, coiled bimetallic spring, or the like may be used to convert the temperature to a signal usable by a processor. The activation device may be, for example, a TRIAC, a solenoid, or the like, to activate the compressor, heater, and so on. The dynamic behavior of thermal systems may be modeled with a second order differential equation in a known manner, using inertial and damping coefficients. The goal is to cycle the auxiliary heater during operation to protect the compressor oil from overheating.

Figure 11A:
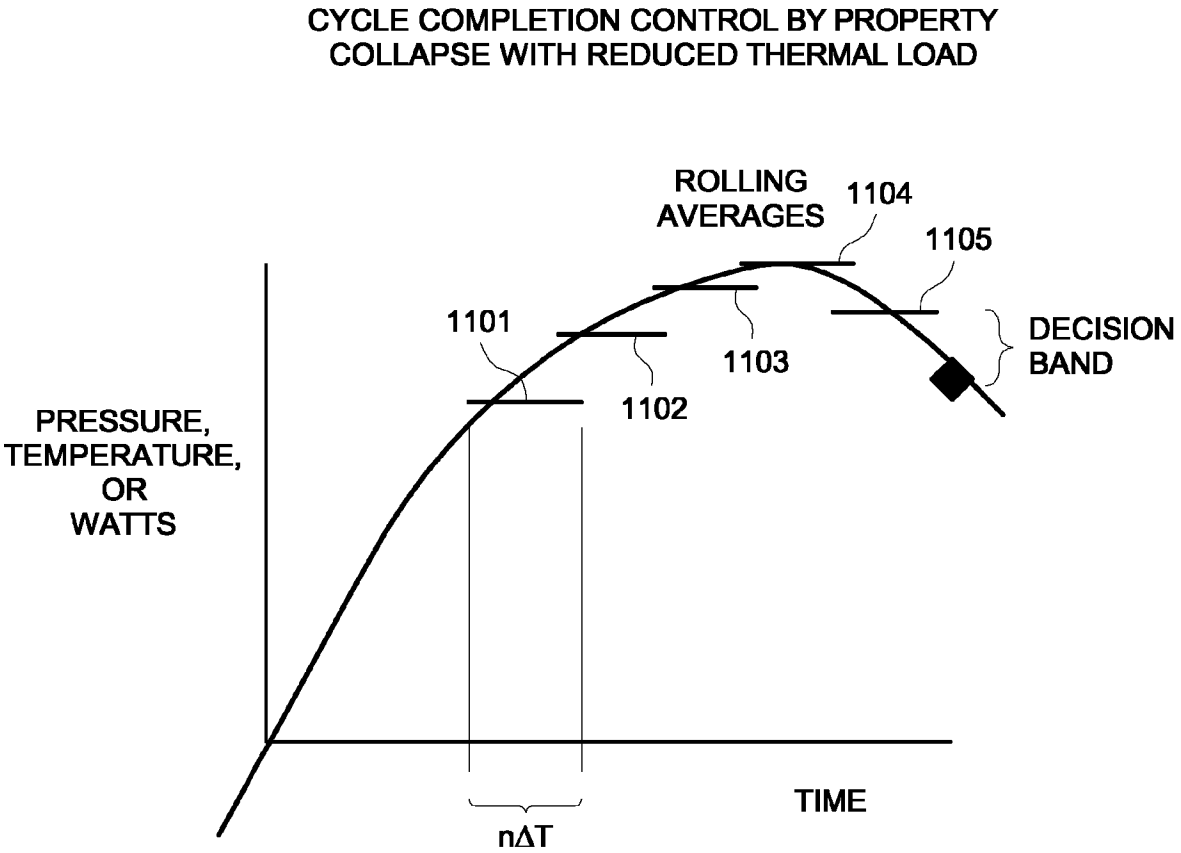
FIG. 11*a* presents pressure, temperature, or wattage versus time for a cycle wherein cycle completion is controlled by declining capacity indication following a maxima, in accordance with a non-limiting exemplary embodiment of the invention.
Figure 11B:
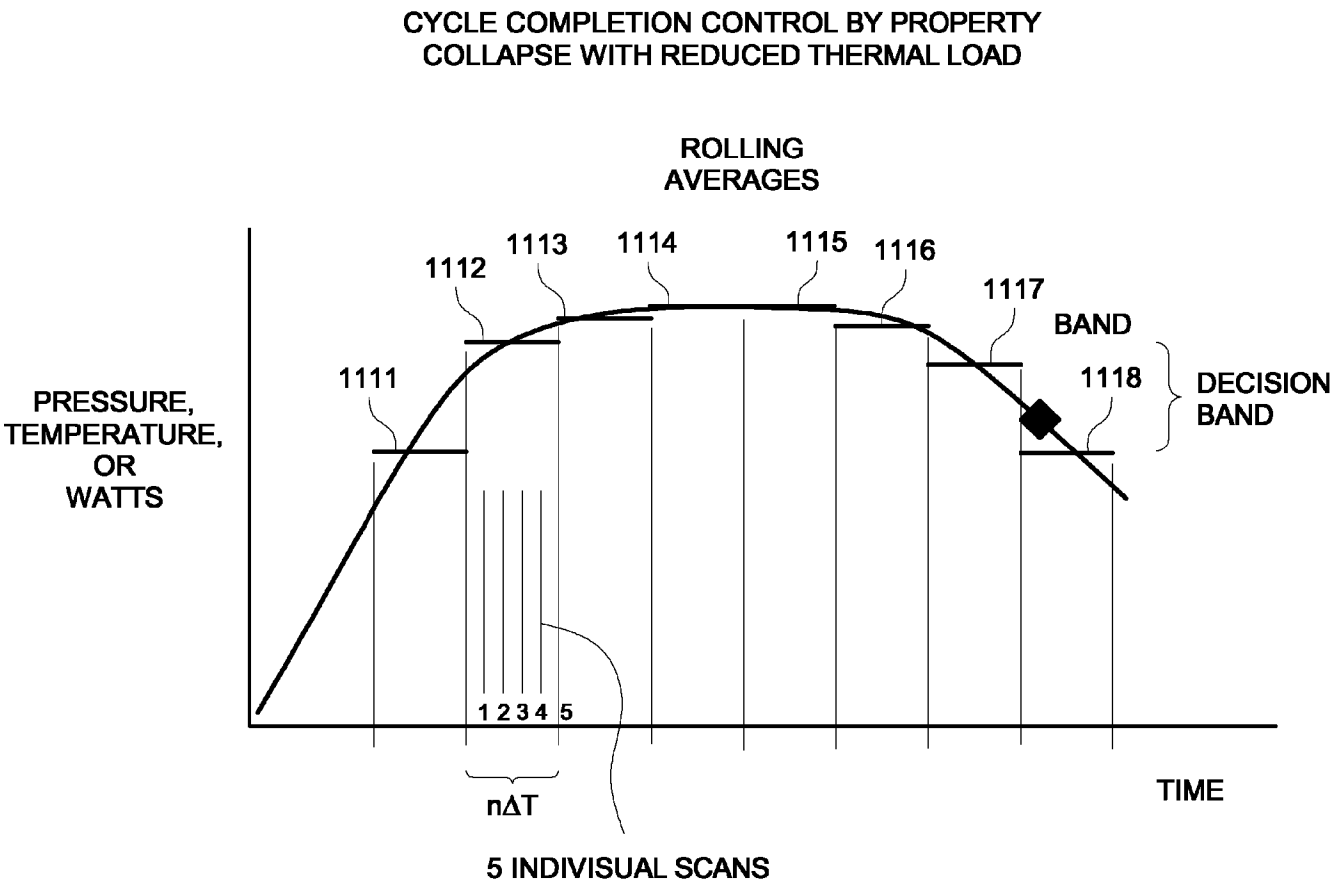
FIG. 11*b* presents pressure, temperature, or wattage versus time for a cycle wherein cycle completion is controlled by declining capacity indication following a period of relatively constant performance, in accordance with a non-limiting exemplary embodiment of the invention.

Reference should now be had to FIG. 11*a* and FIG. 11*b*, which depict aspects related to dry cycle completion control in a heat pump dryer. In particular, dry cycle completion can be controlled by rolling average compressor wattage, or heat exchanger (e.g., condenser) pressure or temperature. It should be noted that these techniques of dry cycle completion control are generally applicable to heat pump dryers, regardless of whether other techniques disclosed herein (such as auxiliary heating) are employed.

As depicted on the vertical axis in FIG. 11*a* and FIG. 11*b*, a pressure, temperature, or power sensor is employed. A non-limiting example is an AC wattmeter. Another non-limiting example is a pressure or temperature sensor 110 at the condenser midpoint. Yet another non-limiting example includes temperature sensors at multiple points (for example, at a condenser midpoint, an evaporator midpoint, a condenser out, and an evaporator out). Accordingly, one or more embodiments of the invention can include using the difference in temperatures between a condenser and an evaporator. Both temperature measurements move toward equilibrium values as the clothes get dryer, and thus, adding the absolute of the two changes can result in a larger and therefore more recognizable signal of system collapse. Such example embodiments also become less sensitive to a coil that moves the fastest or slowest in the system collapse. In one or more embodiments, take a temperature, pressure, or wattage reading at predetermined intervals—say every 3 seconds (as depicted in FIG. 11*b*) ($\Delta T$). As used herein, "n" is the number of temperature scans included in the averaging (for example, n=5 in the example depicted in FIG. 11*b*), and "T" is the time interval for temperature scans. Thus, the average is for a period of "n" times "T" seconds or minutes. These readings are indicated by the hash marks 1101, 1102, 1103, 1104, 1105 in FIG. 11*a*, and by hash marks 1111, 1112, 1113, 1114, 1115, 1116, 1117 and 1118 in FIG. 11*b*. A suitable controller 112 (e.g., processor 1020 and memory 1030) can be employed. For example, the processor takes a predetermined number of signals representing readings of temperatures, pressures, or powers, and stores same in memory 1030 after suitable translation or processing, if required or desired. The processor takes the values of the temperatures, pressures, or powers from memory, performs a suitable calculation such as a mathematical regression, and computes the slope between the last several readings.

The processor preferably averages multiple readings of temperatures, pressures, or powers, preferably three or more readings. By way of example, in FIG. 11*a*, the first slope calculation will be positive; based, for example, on a linear regression straight line fit to the values at 1101, 1102, and 1103. The second slope calculation will discard 1101 and add 1104, such that the linear regression to determine slope will be based on 1102, 1103, and 1104. Eventually the processor will take the last three data points 1103, 1104, and 1105 and carry out the regression on them. As time marches along, the processor drops the oldest value, adds the newest value, and bases the slope calculation on the three values in the register (this can be referred to, for example, as a rolling average). In FIG. 11*a*, each successive calculation will yield a shallower slope, gradually approaching horizontal, and then with a definite negative slope, thus confirming that a point of inflection has been located. In one or more embodiments of the invention, slope can be determined via these techniques for two, three or more sequential intervals and the decision point/condition or threshold slope can be determined accordingly. One or more embodiments of the invention include using averaging to allow a more definite identification of maxima or change from steady. There is always noise in a refrigeration system because the system always hunts but never finds a "steady state." Accordingly, averaging smoothes out the noise in individual readings from scan to scan. Because of this averaging, two decision criteria are available: (i) a delta from a recorded value by comparison, or (ii) the degree of slope calculated from the present and prior average divided by the time between averages.

Accordingly, one or more embodiments of the invention can be implemented in connection with a peaked curve (such as depicted in FIG. 11*a*) or a flattened or steady state type curve (such as depicted in FIG. 11*b*) based on other control inputs. The decision band can include an absolute decrement in pressure, temperature and/or watts, or the decision band can also include a negative slope level such as, for example, −0.1 . . . −0.2 . . . −0.4, at which point a value in a register can lead to powering down the mechanical refrigeration cycle. Additionally, one or more embodiments of the invention can include recording the steady pressure, temperature and/or watts, and when the delta from the pressure, temperature and/or watts equals or exceeds a predetermined negative value, a similar power-down signal can be sent.

Thus, by way of example, in one or more embodiments, carry out a least squares straight line fit to a predetermined number of points (preferably at least three). When a sufficiently negative slope is noted, shut the heat pump dryer cycle down. One or more embodiments sense the slope of a curve of pressure, temperature, or compressor power as a function of time, and make a decision to shut the cycle down when a point of inflection (indicating a maxima of the curve) is reached.

FIG. 11*a* and FIG. 11*b* thus illustrates aspects of dry cycle completion by using the sensing of cycle collapse of a refrigeration system that no longer has a forcing load. Depicted therein is the time history of any of evaporator temperature, pressure or compressor watts when such unloading occurs, latent load, in at least some cases, being the most significant load.

It is believed that one or more embodiments work based on the aspect that as the clothes grow dryer, the load on evaporator 102 goes down and the cycle begins to collapse. Therefore, when this condition is noted, as described with respect to FIG. 11*a* and/or FIG. 11*b*, the cycle can be shut down.

In this regard, current dryers employ sensors which determine a capacitance reading between two electrodes. A low voltage is applied across two points in the dryer (the electrodes, known as "dry rods"). Typical locations include the front or back wall of the dryer, or elsewhere. Given the small applied voltage, if wet cloth touches the two electrodes, a small current will flow, proportional to the amount of water still in the clothing. However, in these kinds of systems, it is typical, that it is no longer possible to obtain a usable signal before the clothes are fully dry (often when the clothes retain about 30% of the moisture). Thus, in these current systems, it is necessary to watch for a zero current reading and then start a timer for the desired degree of drying (say, for a high degree of drying run 15 minutes more, for iron dry, run 10 more minutes, and so on). In contrast, one or more embodiments can produce an actual reading of 100% dry (0% moisture); this enhanced accuracy allows precision in shutting down the dryer with concomitant energy savings by avoiding the approximation and overkill in the timer approach of current techniques.

A variety of pressures and temperatures, as well as compressor power (wattage) can be sensed in order to undertake cycle completion control in accordance with one or more embodiments. In theory, temperature or pressure of the working fluid can be sensed anywhere in the cycle shown in FIG. 1 (from a practical standpoint, a location which is easy to monitor should be selected). Currently, in addition to sensing temperature or pressure of the working fluid at the condenser mid point, as shown at 110, another option is to provide a pressure sensor 111 at the condenser inlet.

Thus, with continued reference to FIG. 11*a* and FIG. 11*b*, measure values of a parameter (working fluid temperature or pressure or compressor wattage) at predetermined intervals 1101-1105 in FIG. 11*a* and 1111-1118 in FIG. 11*b*. The value measured is effectively treated as the average value over some period of time, ΔT, effectively discretizing the curve of power, pressure, or temperature versus time. By way of example, as depicted in FIG. 11*a*, based on the readings at multiple (preferably three or more) points, one or more embodiments of the invention can include examining the curve for points of inflection, indicating a maxima, preferably by monitoring for a change of sign of the slope determined in the slope approximation (for example, by least square fitting). As depicted in FIG. 11*b*, one or more embodiments of the invention can also include examining the curve for a predetermined negative slope level. The "decision band" signifies the act of comparison that determines that the slope, average or delta has reached the criteria in the controller that suggests the cycle objective of "dryness" has been reached (for example, the predetermined decision condition). In one or more embodiments of the invention, that can include a slope value exceeded, a temperature/pressure reached, or a change in temperature/pressure exceeded. With reference now also again to FIG. 1, the periodic readings could be working fluid pressure or temperature at sensors 110 or 111, or a reading from an AC wattmeter 113 in the compressor power lines which senses the compressor power. In one example embodiment of the invention, once a point of inflection indicating a maxima of the curve is noted, controller 112 shuts off compressor 104. By way of example, at cycle completion, the compressor, blower, drum drive, heater (if "on"), pumps, locks and control could be shut off in conjunction as well. Additionally, the door scanner and completion light could then be enabled. Note that controller 112 may or may not be used to carry out other control functions (e.g., heater control) as described elsewhere herein.

One or more embodiments thus utilize refrigeration system load shedding performance to indicated drying completion. Either heat exchanger temperatures and/or pressures or compressor power (Watts) may be used. A refrigeration system running in a heat pump dryer relies on the liberation of water vapor and sensible heating in the reheat portion of the air cycle to maintain load on the evaporator. In the closed system of a heat pump dryer, the evaporator loading is needed to properly load the condenser. If either of these loads is diminished or eliminated, the system is unable to sustain itself and state points collapse. When this occurs the mass flow is reduced and further cycle deterioration and compressor power (Watts) reduction also results.

One significant manifestation of this behavior is when dry-out of the clothes occurs, depriving the evaporator of 66%-80% of its load which is latent. Experimental results show that when a heat pump dryer is approaching 6%>>4% moisture content the cycle deterioration begins in earnest and heat exchanger temperatures and pressures begin falling. In one or more embodiments, by taking a rolling average of either of these properties or the compressor power (Watts), temperature in at least some instances being the easiest to do, and comparing the current value to the rolling average, a convenient and accurate indication of cycle completion can be achieved.

One or more embodiments thus address accurate and more reliable sensing of dry cycle completion, overcoming the inherent difficulty of sensing light loads and reliability of conduction type sensors. One or more embodiments employ components that are readily available and already in the system, with only control logic being necessary. One or more embodiments achieve both a cost and a reliability improvement.

One advantage that may be realized in the practice of some embodiments of the described systems and techniques is easier and more repeatable moisture measurement than dryer rods currently used. Another advantage that may be realized in the practice of some embodiments of the described systems and techniques is more accurate moisture measurement than dryer rods currently used (particularly at low moisture content n ear the end of the drying process). Still another advantage that may be realized in the practice of some embodiments of the described systems and techniques is reduced energy consumption due to more precise cycle control enabled by the more accurate moisture measurement.

Figure 12:
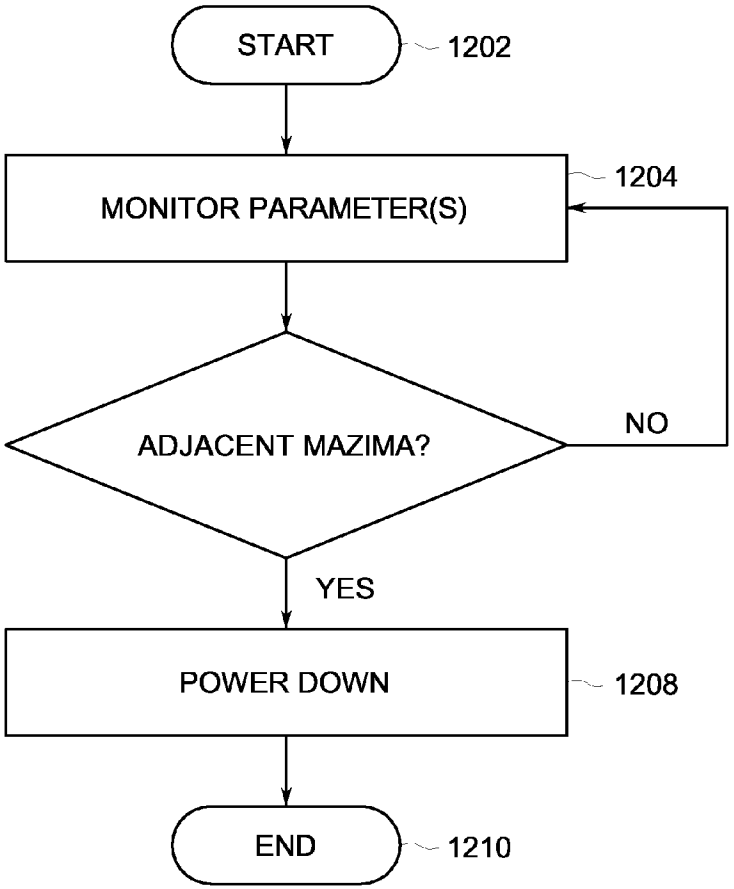
FIG. 12 is a flow chart of a method for controlling cycle completion, in accordance with a non-limiting exemplary embodiment of the invention.

Reference should now be had to flow chart 1200 of FIG. 12, which begins at step 1202. Given the discussion thus far, it will be appreciated that, in general terms, an exemplary method, according to one aspect of the invention, includes the step 1204 of, in a heat pump clothes dryer operating on a mechanical refrigeration cycle, monitoring, as a function of time, at least one parameter. Dryer 250 is a non-limiting example of such a dryer (as noted, auxiliary heater techniques may or may not be employed in connection with dry cycle completion control techniques). The at least one parameter includes working fluid temperature, working fluid pressure, and/or compressor power. An additional step 1206 includes, based on the monitoring, determining whether the at least one parameter monitored as the function of time reaches a predetermined decision condition. In one or more embodiments of the invention, the predetermined decision condition can include one of a maxima of a curve of the at least one parameter monitored as said function of time (such as depicted, for example, in FIG. 11*a*) and a predetermined negative slope level of a curve of the at least one parameter monitored as said function of time (such as depicted, for example in FIG. 11*b*). A further step 1208, if such is the case, i.e., if the at least one parameter monitored as the function of time reaches the predetermined decision condition ("YES" branch of block 1206), includes powering down the mechanical refrigeration cycle. If not adjacent a maxima, in at least some instances, continue to monitor, as per the "NO" branch of block 1206. The end of the logic is shown at 1210.

In some instances, the monitoring as the function of time includes sampling at uniform time intervals to obtain a plurality of samples, such as samples 1101-1105 in FIG. 11*a*. Where such periodic sampling is carried out, in at least some instances, the determining step includes periodically computing a slope value based on a predetermined previous number of the samples (in a preferred but non-limiting approach, at least three).

In at least some cases, the periodic computation of the slope value includes carrying out, for given ones of the uniform time intervals, a linear least-squares fit on the at least three previous samples. Other schemes (e.g., higher order fits with slope taken at one or more predetermined points) could also be used.

The at least one parameter can be monitored in a variety of locations. Purely by way of example and not limitation, working fluid pressure could be monitored at a midpoint of the condenser of the mechanical refrigeration cycle, as at 110, and/or at the inlet of the condenser of the mechanical refrigeration cycle, as at 111. Again, purely by way of example and not limitation, working fluid temperature could be monitored at a midpoint of the condenser of the mechanical refrigeration cycle, as at 110. Compressor power could be monitored, by way of example and not limitation, by AC wattmeter 113.

Further, given the discussion thus far, it will be appreciated that, in general terms, an exemplary apparatus, according to another aspect of the invention, includes a mechanical refrigeration cycle arrangement in turn having a working fluid and an evaporator 102, condenser 106, compressor 104, and an expansion device 108, cooperatively interconnected and containing the working fluid. The apparatus also includes a drum 258 to receive clothes to be dried, a duct and fan arrangement (e.g., 252, 256, 260, 262) configured to pass air over the condenser 106 and through the drum 258, and a sensor (e.g., 110, 111, 113) located to sense at least one parameter. The at least one parameter includes temperature of the working fluid, pressure of the working fluid, and power consumption of the compressor. Also included is a controller 112 coupled to the sensor and the compressor. The controller is preferably operative to carry out or otherwise facilitate any one, some, or all of the method steps described. For example, the controller can monitor, as a function of time, the at least one parameter; based on the monitoring, determine whether the at least one parameter monitored as the function of time reaches a predetermined decision condition; and, if the at least one parameter monitored as the function of time reaches the predetermined decision condition, power down the mechanical refrigeration cycle at least by causing the compressor to shut off.

In some instances, the controller is operative to monitor as the function of time by sampling at uniform time intervals to obtain a plurality of samples, as described with respect to FIG. 11*a* and FIG. 11*b*. Where such periodic sampling is carried out, in at least some instances, the controller is operative to determine by periodically computing a slope value based on a predetermined previous number of the samples (in a preferred but non-limiting approach, at least three).

In at least some cases, the controller is operative to periodically compute the slope value by carrying out, for given ones of the uniform time intervals, a linear least-squares fit on the at least three previous samples.

The comments above, with respect to the method, about the parameters to be monitored and the locations for monitoring same, are equally applicable to the apparatus.

Figure 10:
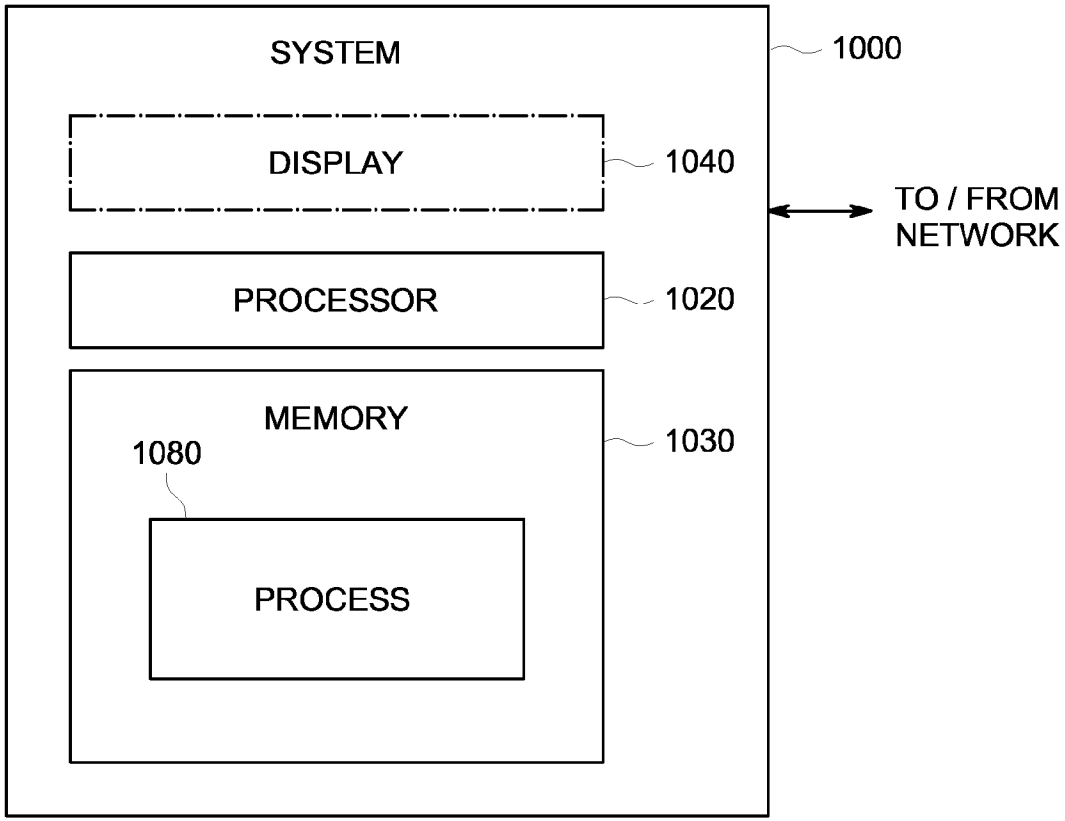
FIG. 10 is a block diagram of an exemplary computer system useful in connection with one or more embodiments of the invention.

Aspects of the invention (for example, controller 112 or a workstation or other computer system to carry out design methodologies) can employ hardware and/or hardware and software aspects. Software includes but is not limited to firmware, resident software, microcode, etc. FIG. 10 is a block diagram of a system 1000 that can implement part or all of one or more aspects or processes of the invention. As shown in FIG. 10, memory 1030 configures the processor 1020 to implement one or more aspects of the methods, steps, and functions disclosed herein (collectively, shown as process 1080 in FIG. 10). Different method steps could theoretically be performed by different processors. The memory 1030 could be distributed or local and the processor 1020 could be distributed or singular. The memory 1030 could be implemented as an electrical, magnetic or optical memory, or any combination of these or other types of storage devices. It should be noted that if distributed processors are employed (for example, in a design process), each distributed processor that makes up processor 1020 generally contains its own addressable memory space. It should also be noted that some or all of computer system 1000 can be incorporated into an application-specific or general-use integrated circuit. For example, one or more method steps (e.g., involving controller 112) could be implemented in hardware in an ASIC rather than using firmware. Display 1040 is representative of a variety of possible input/output devices. Examples of suitable controllers have been set forth above. Additionally, examples of controllers for heater control above can also be used for cycle completion. An example can include a micro with ROM storage of constants and formulae which perform the necessary calculations and comparisons to make the appropriate decisions regarding cycle termination.

As is known in the art, part or all of one or more aspects of the methods and apparatus discussed herein may be distributed as an article of manufacture that itself comprises a tangible computer readable recordable storage medium having computer readable code means embodied thereon. The computer readable program code means is operable, in conjunction with a processor or other computer system, to carry out all or some of the steps to perform the methods or create the apparatuses discussed herein. A computer-usable medium may, in general, be a recordable medium (e.g., floppy disks, hard drives, compact disks, EEPROMs, or memory cards) or may be a transmission medium (e.g., a network comprising fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer to read instructions and data, such as magnetic variations on a magnetic medium or height variations on the surface of a compact disk. The medium can be distributed on multiple physical devices (or over multiple networks). As used herein, a tangible computer-readable recordable storage medium is intended to encompass a recordable medium, examples of which are set forth above, but is not intended to encompass a transmission medium or disembodied signal.

The computer system can contain a memory that will configure associated processors to implement the methods, steps, and functions disclosed herein. The memories could be distributed or local and the processors could be distributed or singular. The memories could be implemented as an electrical, magnetic or optical memory, or any combination of these or other types of storage devices. Moreover, the term "memory" should be construed broadly enough to encompass any information able to be read from or written to an address in the addressable space accessed by an associated processor. With this definition, information on a network is still within a memory because the associated processor can retrieve the information from the network.

Thus, elements of one or more embodiments of the invention, such as, for example, the controller 112, can make use of computer technology with appropriate instructions to implement method steps described herein.

Accordingly, it will be appreciated that one or more embodiments of the present invention can include a computer program comprising computer program code means adapted to perform one or all of the steps of any methods or claims set forth herein when such program is run on a computer, and that such program may be embodied on a computer readable medium. Further, one or more embodiments of the present invention can include a computer comprising code adapted to cause the computer to carry out one or more steps of methods or claims set forth herein, together with one or more apparatus elements or features as depicted and described herein.

It will be understood that processors or computers employed in some aspects may or may not include a display, keyboard, or other input/output components. In some cases, an interface with sensor 110 is provided.

It should also be noted that the exemplary temperature and pressure values herein have been developed for Refrigerant R-134a; however, the invention is not limited to use with any particular refrigerant. For example, in some instances Refrigerant R-410A could be used. The skilled artisan will be able to determine optimal values of various parameters for other refrigerants, given the teachings herein.

Thus, while there have shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method comprising the steps of:

in a heat pump clothes dryer operating on a mechanical refrigeration cycle, monitoring, as a function of time, at least one parameter, said at least one parameter in turn comprising at least one of:
working fluid temperature;
working fluid pressure; and
compressor power;

based on said monitoring, determining whether said at least one parameter monitored as said function of time reaches a predetermined decision condition; and if said at least one parameter monitored as said function of time reaches the predetermined decision condition, powering down said mechanical refrigeration cycle, wherein said monitoring as said function of time comprises sampling at uniform time intervals to obtain a plurality of samples.

2. The method of claim 1, wherein the predetermined decision condition comprises a maxima of a curve of the at least one parameter monitored as said function of time.

3. The method of claim 1, wherein the predetermined decision condition comprises a predetermined negative slope level of a curve of the at least one parameter monitored as said function of time.

4. The method of claim 1, wherein said determining comprises periodically computing a slope value based on a predetermined previous number of said samples.

5. The method of claim 4, wherein said predetermined previous number of said samples is at least three.

6. The method of claim 5, wherein said periodic computation of said slope value comprises carrying out, for given ones of said uniform time intervals, a linear least-squares fit on said at least three previous samples.

7. The method of claim 6, wherein said at least one parameter comprises said working fluid pressure.

8. The method of claim 7, wherein said monitoring, is carried out at a midpoint of a condenser of said mechanical refrigeration cycle.

9. The method of claim 7, wherein said monitoring is carried out at an inlet of a condenser of said mechanical refrigeration cycle.

10. The method of claim 6, wherein said at least one parameter comprises said working fluid temperature.

11. The method of claim 10, wherein said monitoring is carried out at a midpoint of a condenser of said mechanical refrigeration cycle.

12. The method of claim 10, wherein said at least one parameter comprises said compressor power.

13. An apparatus comprising:

a mechanical refrigeration cycle arrangement comprising:
a working fluid; and
an evaporator, a condenser, a compressor, and an expansion device, cooperatively interconnected and containing said working fluid;

a drum to receive clothes to be dried;

a duct and fan arrangement configured to pass air over said condenser and through said drum;

a sensor located to sense at least one parameter, said at least one parameter comprising at least one of:
temperature of said working fluid;
pressure of said working fluid; and
power consumption of said compressor; and a controller coupled to said sensor and said compressor, said controller being operative to:
monitor, as a function of time, said at least one parameter;
based on said monitoring, determine whether said at least one parameter monitored as said function of time reaches a predetermined decision condition; and
if said at least one parameter monitored as said function of time reaches the predetermined decision condition, power down said mechanical refrigeration cycle at least by causing said compressor to shut off, wherein said controller is operative to monitor as said function of time by sampling at uniform time intervals to obtain a plurality of samples.

14. The apparatus of claim 13, wherein said controller is further operative to, if said at least one parameter monitored as said function of time reaches said predetermined decision condition, power down said mechanical refrigeration cycle at least by causing at least one of a blower, a drum drive, a heater, a pump, and a lock to shut off.

15. The apparatus of claim 13, wherein said controller is operative to determine by periodically computing a slope value based on a predetermined previous number of said samples.

16. The apparatus of claim 15, wherein said predetermined previous number of said samples is at least three.

17. The apparatus of claim 16, wherein said controller is operative to periodically compute said slope value by carrying out, for given ones of said uniform time intervals, a linear least-squares fit on said at least three previous samples.

18. The apparatus of claim 17, wherein said at least one parameter comprises said working fluid pressure.

19. The apparatus of claim 18, wherein said condenser has a midpoint and wherein said sensor is located at said midpoint of said condenser.

20. The apparatus of claim 18, wherein said condenser has an inlet at wherein said sensor is located at said inlet of said condenser.

21. The apparatus of claim 17, wherein said at least one parameter comprises said working fluid temperature.

22. The apparatus of claim 21, wherein said condenser has a midpoint and wherein said sensor is located at said midpoint of said condenser.

23. The apparatus of claim 16, wherein said at least one parameter comprises said compressor power.

24. The apparatus of claim 13, wherein the predetermined decision condition comprises a maxima of a curve of the at least one parameter monitored as said function of time.

* * * * *